US011518187B2

(12) United States Patent
King

(10) Patent No.: US 11,518,187 B2
(45) Date of Patent: Dec. 6, 2022

(54) METHOD OF FLEXOGRAPHICALLY PRODUCING A FAUX GALVANIZED METAL FINISH ON A SUBSTRATE

(71) Applicant: STEELSCAPE, LLC, Kalama, WA (US)

(72) Inventor: Jonathan Charles King, Longview, WA (US)

(73) Assignee: STEELSCAPE, LLC, Kalama, WA (US)

( * ) Notice: Subject to any disclaimer, the term of this patent is extended or adjusted under 35 U.S.C. 154(b) by 470 days.

(21) Appl. No.: 16/732,548

(22) Filed: Jan. 2, 2020

(65) Prior Publication Data

US 2021/0206197 A1 Jul. 8, 2021

(51) Int. Cl.

| | |
|---|---|
| ***B41M 1/04*** | (2006.01) |
| ***B41M 1/28*** | (2006.01) |
| ***B05D 1/28*** | (2006.01) |
| ***B41M 7/00*** | (2006.01) |
| ***B05D 5/06*** | (2006.01) |
| ***B05D 7/14*** | (2006.01) |
| ***B05D 3/02*** | (2006.01) |
| ***B44F 9/10*** | (2006.01) |
| ***B41M 5/00*** | (2006.01) |
| ***B41M 5/03*** | (2006.01) |
| *B05D 7/00* | (2006.01) |

(52) U.S. Cl.

CPC ..... *B44F 9/10* (2013.01); *B05D 1/28* (2013.01); *B05D 5/06* (2013.01); *B05D 5/063* (2013.01); *B05D 7/14* (2013.01); *B41M 1/04* (2013.01); *B41M 1/28* (2013.01); *B41M 5/0011* (2013.01); *B41M 5/0058* (2013.01); *B41M 5/03* (2013.01); *B41M 7/0054* (2013.01); *B05D 3/0272* (2013.01); *B05D 7/536* (2013.01); *B05D 2252/02* (2013.01); *B05D 2506/10* (2013.01); *B41M 2205/40* (2013.01)

(58) Field of Classification Search

CPC . B05D 1/28; B05D 1/38; B05D 3/002; B05D 3/0236; B05D 3/0272; B05D 5/061; B05D 7/16; B05D 7/536; B05D 7/546; B05D 2202/00; B05D 2252/02; B05D 2506/10; B44F 9/10; B41M 1/06; B41M 1/28; B41M 7/0054

See application file for complete search history.

(56) References Cited

U.S. PATENT DOCUMENTS

2018/0056688 A1* 3/2018 Courtney ..... B41F 5/24

FOREIGN PATENT DOCUMENTS

JP 2004216803 A * 8/2004

* cited by examiner

*Primary Examiner* — William P Fletcher, III

(74) *Attorney, Agent, or Firm* — Lathrop GPM LLP

(57) ABSTRACT

A coiled metal substrate with a faux galvanized surface appearance. The faux galvanized surface of the substrate including a spangle print pattern of polyvinylidene fluoride (PFDV) flexographically applied to the metal substrate. Atop the PFDV print pattern is semi-transparent coating of fluoroethylene vinyl ether (FEVE) flexographically applied atop the spangle print pattern of PFDV.

7 Claims, 5 Drawing Sheets

METHOD OF FLEXOGRAPHICALLY PRODUCING A FAUX GALVANIZED METAL FINISH ON A SUBSTRATE

TECHNICAL FIELD

This disclosure relates to a method of flexographically producing a faux galvanized finish on a metal substrate.

BACKGROUND

Galvanizing is one of the most widely used methods for protecting metal from corrosion. It involves applying a thin coating of zinc to a thicker base metal, helping to shield it from the surrounding environment. Without the protective zinc coating, the metal would remain exposed to the elements and potentially oxidize and corrode much faster. Galvanized steel is a cost-effective alternative to using materials such as austenitic stainless steel or aluminum to prevent corrosion.

Galvanizing can also protect metal through a process called "galvanic corrosion". Galvanic corrosion occurs when two metals of a different electrochemical make up are placed into contact with one another with an electrolyte present, such as salty water. Depending on the atomic structure of the two metals, one metal is the anode and the other is the cathode. The anode corrodes more rapidly than it would by itself and the cathode corrodes at a slower pace than it would by itself. The reason zinc is used for galvanizing is because it has an affinity towards being the anode when in contact with many different types of metals. Since the zinc coating in contact with the base metal is usually the anode, it slows the corrosion of the base metal, or the cathode.

As the name implies, hot-dip galvanization involves dipping the base metal into a molten pool of zinc. First, the base metal must be cleaned either mechanically, chemically, or both to assure a quality bond can be made between the base metal and the zinc coating. Once cleaned, the base metal is then fluxed to rid it of any residual oxides that might remain after the cleaning process. The base metal is then dipped into a liquid bath of heated zinc and a metallurgical bond is formed.

Pre-galvanizing method is very similar to hot-dip galvanizing but is performed at the steel mill, usually on materials that already have a specific shape. Pre-galvanizing involves rolling metal sheet through a similar cleaning process to that of the hot-dip galvanizing process. The metal is then passed through a pool of hot, liquid zinc and then recoiled. An advantage of this method is that large coils of steel sheet can be rapidly galvanized with a more uniform coating compared to hot-dip galvanizing. A disadvantage is that once fabrication of the pre-galvanized metal begins, exposed, uncoated areas will become present. This means that when a long coil of sheet is cut into smaller sizes, the edges where the metal is cut are left exposed.

Unlike the previous processes, electro-galvanizing does not use a molten bath of zinc. Instead, this process utilizes an electrical current in an electrolyte solution to transfer zinc ions onto the base metal. This involves electrically reducing positively charged zinc ions to zinc metal which are then deposited on the positively charged material. Grain refiners can also be added which helps to ensure a smooth zinc coating on the steel. Like the pre-galvanizing process, electro-galvanizing is typically applied continuously to a roll of sheet metal. Some advantages of this process are a uniform coating and precise coating thickness. However, the coating is typically thinner than the coating of zinc achieved by the hot-dip galvanizing method which can result in reduced corrosion protection.

The above described methods of galvanizing a metal substrate are well known in the art and have been in use in industry for decades. However, alternative means of protecting metal have been developed that have superseded galvanization. While such methods have proven themselves to be enormously successful in protecting the metal substrate from oxidation they provide a different appearance. Many members of the consuming public relish the robust and protective appearance of metal that has a galvanic coating. In particular, consumers have come to view the spangle pattern of galvanized steel as highly appealing because it signifies that the metal is protected against corrosion.

The spangle is a unique and interesting formation on the galvanized surface. It is formed when liquid zinc adhering to a steel surface is cooled to temperatures below the melting point of zinc. The zinc atoms, which are randomly arranged in the liquid form, start to position themselves in an orderly pattern at random locations within the molten zinc coating. This process of transforming from disorderly atoms in the liquid state to an orderly pattern is solidification or crystallization.

These small solidifying regions in the molten zinc are referred to as grains. Grain growth occurs when individual atoms from the molten zinc continue attaching themselves to the solidifying grain in an orderly pattern. The individual atoms of the growing solid grain arrange themselves into the often-visible hexagonal symmetry of the final spangle. When the coating solidifies completely, the individual spangles formed represent the respective zinc grains.

Dendritic growth is a different solidification process that also gives rise to spangles in a galvanized steel sheet. Spangles produced in this process have a snowflake appearance. Factors that affect spangle size are:

Zinc chemistry
Cooling rate
Smoothness of the substrate
Impurities
Alloying element Exemplary galvanized steel spangle patterns are often classified as regular, minimized or zero spangle.

SUMMARY

The system and method disclosed herein is for flexographically applying a faux galvanized finish to a metal substrate. Flexography is a form of rotary printing in which a coating, often referred to as ink, is applied to various surfaces by means of flexible rubber (or other elastomeric) printing plates. The inks used in flexography typically dry quickly through evaporation.

In flexography, the desired imagery or lettering is engraved in the form of tiny indentations, or cells, onto a flexible rubber plate by means of plastic-molding techniques or laser engraving. Liquid ink is flooded onto a rotating ink-metering roller while a blade inclined at a reverse angle to the direction of rotation shaves any surplus ink from the ink-metering roller. The remaining ink is rolled onto the rubber printing plate, which is affixed to a rotary letterpress cylinder, and the plate's tiny indentations receive and hold the ink. The inked plate then transfers the image or type to metal (or some other material) that is held on an impression cylinder.

Flexography as disclosed herein is used as a quick and economical way of applying simple designs to coiled metal.

The inks/coatings used in the flexographic process can be overlaid to achieve highly desirable special effects such as the spangling to imitate the appearance of galvanization.

Various objects, features, aspects and advantages of the disclosed subject matter will become more apparent from the following detailed description of preferred embodiments, along with the accompanying drawings in which like numerals represent like components. The contents of this summary section are provided only as a simplified introduction to the disclosure, and are not intended to be used to limit the scope of the appended claims.

The contents of this summary section are provided only as a simplified introduction to the disclosure, and are not intended to be used to limit the scope of the appended claims.

DEFINITIONS

NIP pressure—is the pressure between two rollers that are forced together.

KISS pressure—is the minimum pressure required to produce the proper coating transfer from the print sleeve on the applicator roller to the substrate.

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims Sheet metal is the most widely used pre-galvanized. The sheet metal is uncoiled and passed through a reducing atmosphere prior to immersion in the galvanizing bath for a relatively short period of time. Upon withdrawal from the galvanizing bath, either an air knife or mechanical wiper is used to remove excess zinc to produce a good surface finish. The result however is a thin coating which may vary from 0.28-1.65 mils according to grade with most products typically having a coating thickness of 0.79 mils. After galvanizing, the sheet is recoiled and ultimately cut for sale.

Disclosed herein is a system and method for flexographically producing a faux galvanized metal finish on coiled sheet metal. Various embodiments of the faux galvanized sheet metal surface produced using the system and method as disclosed herein can be seen in FIGS. 1A-1C. Flexography is a form of a printing process which utilizes a flexible relief plate that is well known in the industry. A unique ability of flexography is that it can print a continuous image of various repeat lengths by means of a design roll. A design roll is an engraved roll with a continuously repeating image around its circumference.

Figure 2:
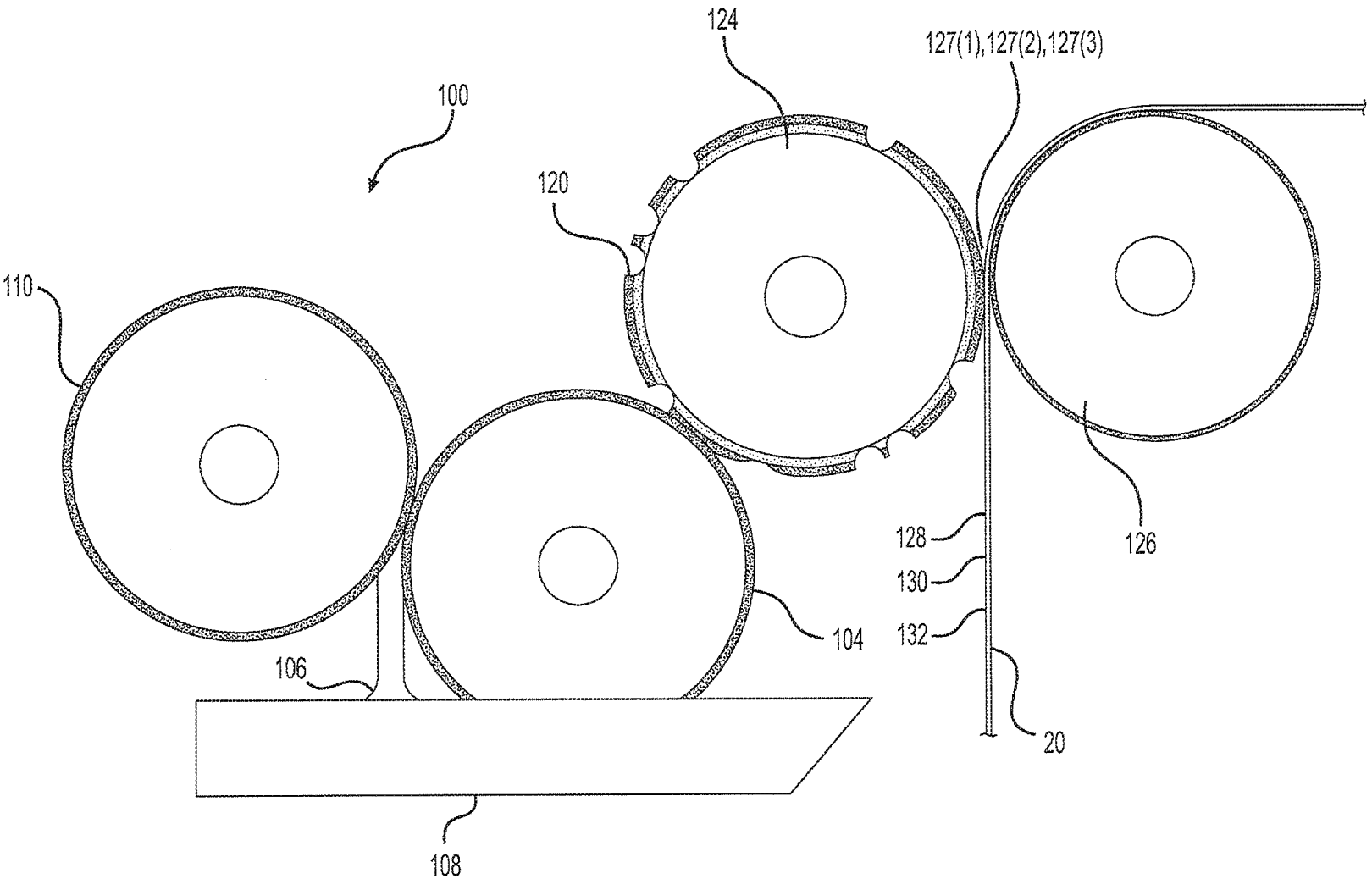
FIG. 2 depicts an embodiment of an exemplary flexographic print system

As shown in FIG. 2, a flexographic printing system 100 is essentially a modern version of a letterpress which can be used for printing on almost any type of substrate. The flexographic system 100 is widely used for printing on non-porous substrates 20 required for various types of materials, for example, sheet metal. It is also well suited for printing recurring patterns such as in the instant application. In a standard flexographic operation, the pick-up roller 104 transfers the coating 106 that is located in the coating pan 108 to the second roller which is the anilox roller or "metering" roller 110.

As further shown in FIG. 2, the pick-up roller 104, which is generally rubber-covered, picks up a thick film of coating 106 and transfers it to a metering roller 110, also known in flexography as an anilox roller. The metering roller is a chrome or ceramic covered roller whose surface contains small, engraved pits or cells (typically from 80 to 1,000 cells per inch). The pressure between the pick-up roller 104 and the metering roller 110 is set so that the excess coating is squeezed from the line contact between them. The goal is to ensure that only the metered coating stored in the rubber covering of the pick-up roll 104 is transferred to the flexible rubber relief plate or print sleeve 120 of the applicator roll 124.

After the cells of the pick-up roller 104 are filled with coating 106, the coating 106 is metered by the metering roller 110. On some presses, the metering roller 110 is the only roller in the coating system, rotating in the coating pan 108 and delivering a coating 106 directly to the print sleeve 120 on the applicator roll 124. On other presses, the pick-up roller 104 delivers coating from the coating pan 108 to the metering roller 110 before the pick-up roll 104 unloads coating 106 to the flexible sleeve 120 of the applicator roll 124. The substrate 20 passes between the print sleeve 120 of the applicator roll 124 and the backup drum with coating applied by the print sleeve 120.

As discussed above, FIG. 2 details the flexographic coating applicator hardware 104, 110, 120, 124, 126 of the coating line 100 through which the substrate 20 passes wherein the applicator roll 124 is responsible for applying 127(1) a pretreatment 128 solution to the substrate 20 as well as for applying 127(2) a faux galvanized print pattern 130 atop the substrate 20 after the pretreatment solution and also applying 127(3) to the printed pattern atop the substrate 20 a protective coating 132 with the at least one coating system 100.

The nature and demands of the printing process and the application of the printed product determine the fundamental properties required of flexographic coatings. Measuring the physical properties of coatings and understanding how these are affected by the choice of ingredients is a significant factor in coating technology. Formulation of coatings requires a detailed knowledge of the physical and chemical properties of the raw materials composing the coatings, and how these ingredients affect or react with each other as well as with the substrate. Flexographic printing coatings are primarily formulated to remain compatible with the wide variety of substrates used in the process. Each formulation component individually fulfills a special function and the proportion and composition will vary according to the substrate.

There are a range of coatings that can be used in flexography: solvent-based coatings, water-based coatings, electron beam curing coatings, ultraviolet curing coatings and two-part chemically-curing coatings (usually based on polyurethane isocyanate reactions), although these are less common. The coating is controlled in the flexographic printing process by the coating unit.

Flexographic coatings 106 are subject to evaporation, resulting in changes in viscosity and pH, making it necessary to monitor, adjust and test the coating before printing and during the press run. Coating viscosity—resistance to flow—is measured using a viscosity measurement cup, or efflux cup. The most common is the #4 Zahn cup, a small metal cup attached to a long handle with a precisely-sized small hole drilled in the bottom. By dipping the cup in the coating and measuring in seconds the amount of time it takes for the coating to empty through the hole, the operator can evaluate viscosity. The longer it takes for the Zahn cup to empty, the higher the viscosity of the coating. If the coating viscosity is too high, the coating needs to be thinned using water or solvent. Once viscosity is controlled, an electronic pH meter is used to verify that the coating is within the specified target pH range, usually between 8.0 and 9.5, or slightly alkaline, in the case of water-based coatings. Proper pH control is necessary to ensure proper laydown and drying of the coating.

Figure 1A:
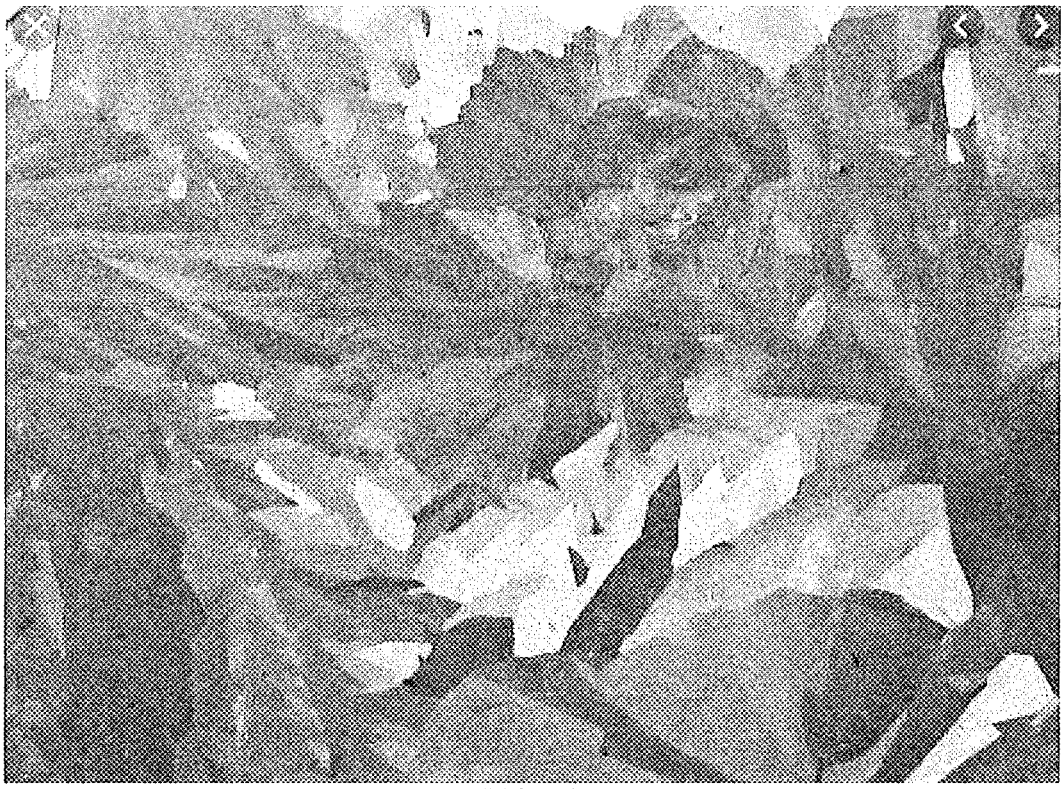
FIG. 1A depicts an embodiment of a galvanized metal surface spangle pattern.
Figure 1B:
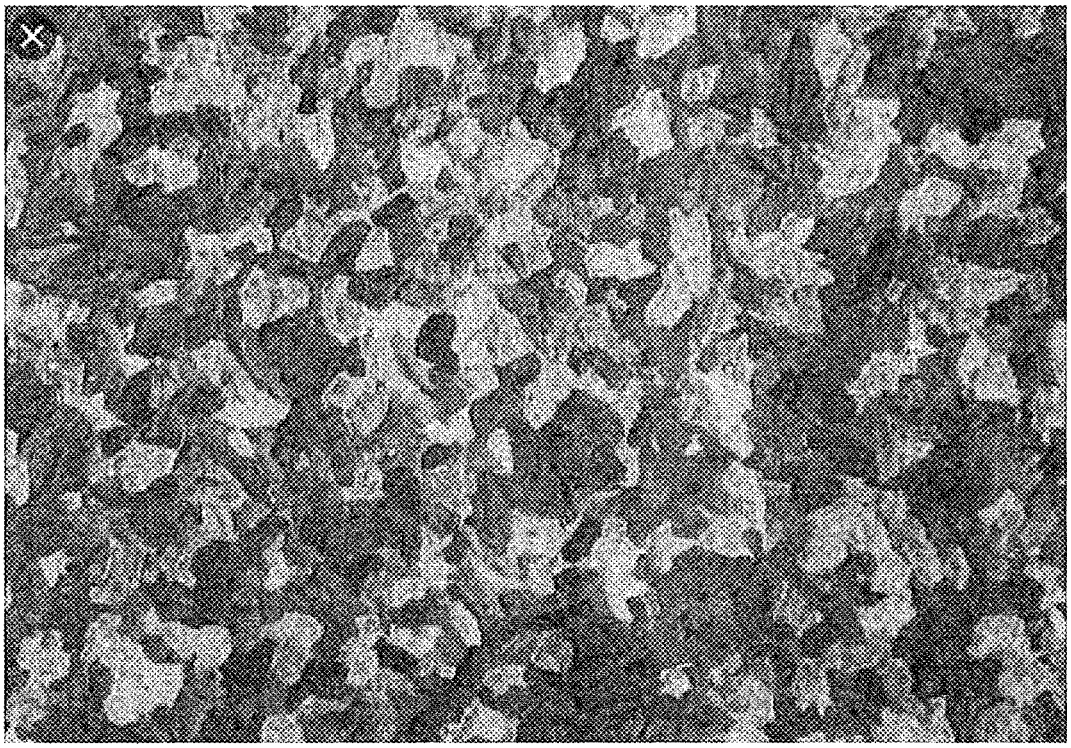
FIG. 1B depicts an embodiment of a galvanized metal surface spangle pattern.
Figure 1C:
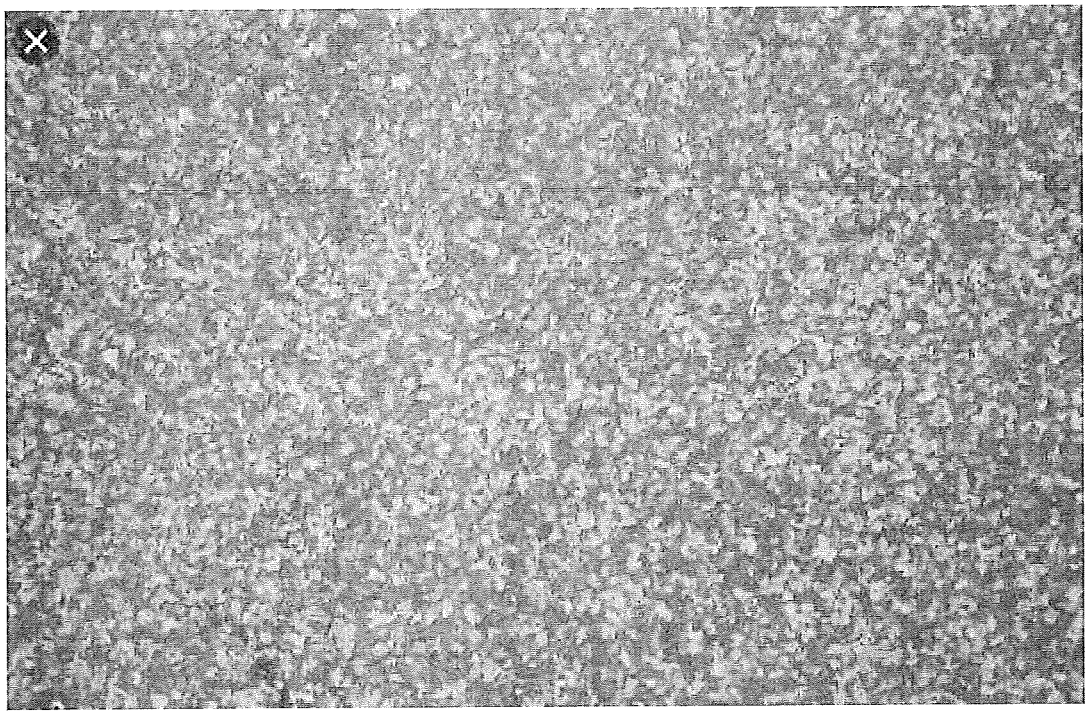
FIG. 1C depicts an embodiment of a galvanized metal surface spangle pattern.
Figure 3:
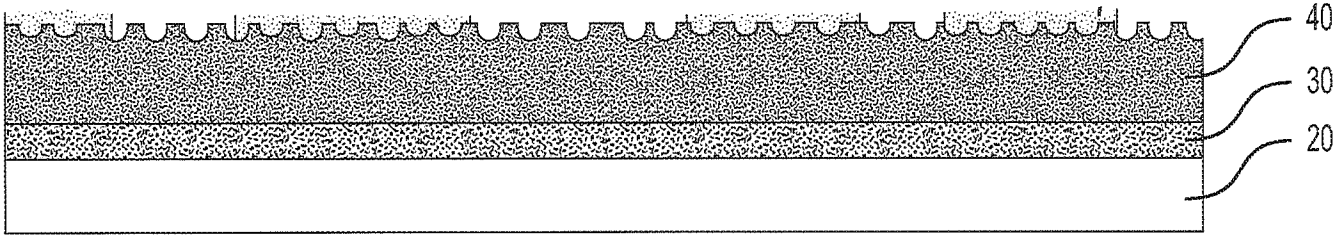
FIG. 3 depicts a cross-sectional elevation view of the layers applied by the flexographic faux galvanizing process.

As previously noted, FIGS. 1A-1C depict embodiments of a metal panel surface with the application of a faux galvanized spangle pattern. The embodiments detailed in FIGS. 1A-1C are representative of the output of the process disclosed herein. FIG. 3 is a cross-sectional elevation view of the layers of coatings that are applied using the above disclosed flexographic equipment and the process sequence as described below. The substrate layer 20 is preferably a thin steel or aluminum rolled sheet material. The first procedure to increase the longevity and durability of the soon to be applied coatings is a pretreatment application, in the form of a solution, that is applied to facilitate adherence of the print pattern 30 and the protective coating 40 responsible for creating, and protecting, the faux galvanized appearance.

An exemplary pretreatment solution is the product Permatreat® 1500 formulated by Chemetall. This pretreatment is used to assist the faux galvanizing print pattern 30 to adhere to the substrate 20. Pretreatment solutions from other vendors may be utilized to provide the desired level of adherence and durability. Positioned atop the substrate 20 is the coating 30 that creates the spangled faux galvanized appearance. The faux galvanized print 30 is applied by flexographic rollers as described above. The semi-transparent protective coating 40 positioned atop the faux galvanized pattern 30 is applied following the application of the faux galvanized coating 30 by the coil coating line as is described in greater detail below.

The method of fabricating the flexographically coated substrate, or metal coil, requires many production parameters to be precisely controlled to achieve the desired visual effect and long-term durability of the coated substrate 20. In operation, the leading edge of a metal coil weighing in the range of from 20,000 to 40,000 pounds and comprised of either aluminum or steel, of a thickness typically between 0.010 and 0.070 inches with a coil width typically between 20 and 60 inches is introduced into the feed end of the coil coating line. These coils range from about 5,000 feet to about 10,000 feet in length and are uncoiled by the coil coating line at speeds that can approach 250 fpm.

Figure 4:
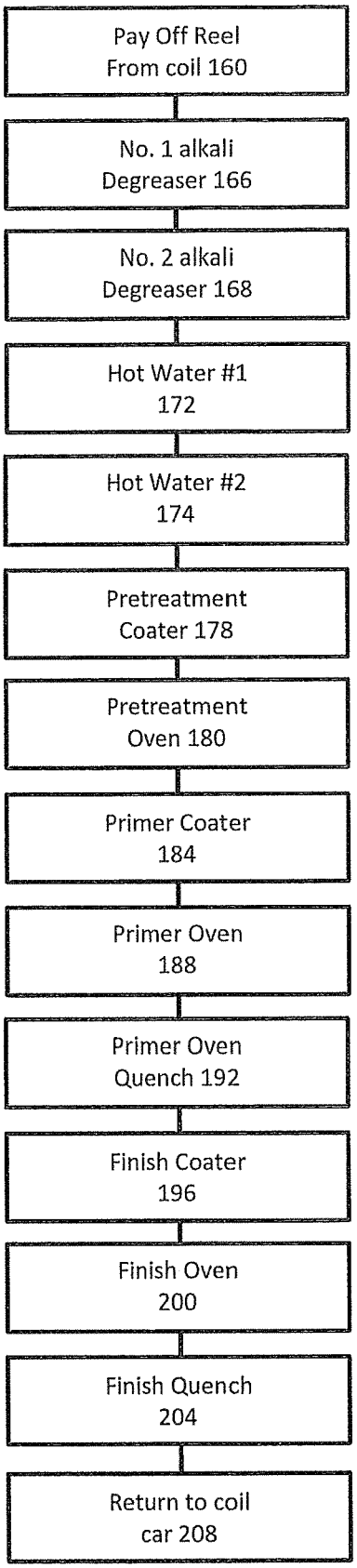
FIG. 4 is a process flow diagram for a method of flexographically producing a faux galvanized appearance on the surface of a coiled metal substrate.

The substrate 20 passes through multiple operations in the coil coating line to achieve the desired final appearance and weatherability. FIG. 4 provides a process flow diagram of the coating line processes. The substrate 20 in the form of a coiled roll is payed off (uncoiled) and fed into the coating line. The first process the substrate 20 will undergo is the pretreatment section of the coating line. The pretreatment section rinses the substrate 20 with a solution that removes oily residue that could prevent optimal adherence of the faux galvanized print pattern 30 providing the faux galvanized appearance. A first alkali degreaser is first employed at process step 166 followed by a second alkali degreaser at process step 168. The alkali degreasers do as the name suggests and that is to remove any oil residual that may be adhering to the substrate 20. After passing through the second alkali degreasing step 168, the substrate passes through a first and second hot water process 172, 174 to remove any remaining alkali degreasing solution that may continue to reside on the substrate 20. Next the substrate 20 moves onto a pretreatment coater station 178.

A pretreatment solution, such as, Permatreat® 1500 supplied by Chemetall, is used to assist the faux galvanizing coating 40 to adhere to the substrate 20. The coating process in the pretreatment coater 178 occurs at ambient temperature and the pretreatment solution is rolled onto the substrate 20 utilizing the print sleeve 120 of an applicator roll 124. The pretreatment solution acts as a rust preventer and serves to protect the metal surface from corrosion. The pretreatment solution also improves adhesion of the coating 40 to the substrate 20. The pretreatment solution micro etches the substrate to allow the applied coating to adhere to the substrate. Failing to utilize the pretreatment process would likely result in the coating peeling from the substrate. The pretreatment solution is applied across the full width of the strip on both top and bottom sides. The pretreatment is roll coat applied to the substrate preferably in the range of about 10-12 mg/ft$^2$ and the application density is measured, for example with a Portaspec®, a wavelength dispersive x-ray fluorescence analyzer that measures the coating weights of pretreatments.

After exiting the pretreatment coater 178 the substrate 20 traverses to the pretreatment oven 180 which raises the temperature of the substrate 20 and applied pretreatment to approximately 300° F. The substrate 20 has only a short residence time in the pretreatment oven 180 sufficient to quickly evaporate the pretreatment materials from the surface of the substrate 20. A large air knife is positioned outside of the pretreatment ovens and directs high-pressure air over the surface of the substrate 20 to remove any debris that may be adhering to the substrate surface and further provides some nominal cooling to the substrate 20.

The substrate 20 then continues onto another flexographic printing station where a flexographic roll pattern that has preferably been laser cut into a print sleeve is used to apply a PVDF (Polyvinylidene Fluoride) pattern directly to the pretreated substrate 20. PVDF is sold under a variety of brand names including KF (Kureha), Hylar (Solvay), Kynar (Arkema) and Solef (Solvay). PVDF is a highly non-reactive thermoplastic fluoropolymer produced by the polymerization of vinylidene difluoride. PVDF is a specialty plastic used in applications requiring resistance to solvents, acids, hydrocarbons, is highly abrasion and flame resistant and is stable when exposed to ultraviolet light.

The spangle roll pattern 30 can be applied in any pattern or size that is desirable to the customer to include spangle sizes that are regular or minimized and the spangle pattern can be either a chunky pattern effect or brushed pattern effect. The spangle pattern can have the appearance of a sponge dipped application of the coating to the substrate. The viscosity of the pattern material prior to application is set to 22-23 seconds using a #4Zahn cup at a temperature of 75° F. In this flexographic operation, the metering roll and the NIP are set to 650 lbs of pressure while the KISS is set to 120 lbs of pressure. The applied print film is preferably in the range of about 0.2 to 0.3 mils in thickness and the process line speed is set to about 220 fpm with the substrate 20 passing between an applicator roll 124 with a print sleeve 120 and a backup drum 126.

Upon exiting the primer coater 184, the PVDF printed substrate 20 enters a primer oven 188 where the substrate 20 and applied pattern 30 achieve a peak metal temperature in the range of about 455° F. to 475° F. with an even more preferred peak metal temperature of about 465° F. This peak metal temperature range serves to volatilize solvents or evaporate water from the print pattern 30. The substrate 20 and adhered print 30 have a residence time of approximately 48 seconds as they traverse through the primer oven 188. Oven residence times and peak metal temperature parameters may vary depending upon the print compositions, substrate dimensions and other operational parameters.

Once the printed substrate exits the primer oven 188, the material enters the primer oven quench 192 which is comprised of several sequentially disposed spray bars that cool the primed substrate with multiple shower heads dispensing cooling water to lower the substrate temperature to well below the preferred peak metal temperature range of 455° F. to 475° F. achieved within the primer oven 188.

As the printed substrate exits the primer oven quench 192 it traverses to a finish coater 196 which is typically a two-roll application process. The two rolls apply a coating at a temperature of about 80° F. with a viscosity of 21 seconds measured with a #4 Zahn cup. A semi-transparent coating comprised of Fluoroethylene Vinyl Ether (FEVE) is applied over the printed substrate with a preferred thickness in the range of about 0.50 and 0.60 mils. The thickness being controlled by adjustment of the NIP pressure measured at the interface between the applicator roll 124 and the backup drum 126. The NIP is preferably set to 600 lbs of pressure and the KISS is preferably set to 500 lbs of pressure.

These NIP and KISS pressures are critical to achieve the desired thickness of FEVE and most importantly to protect the faux galvanized pattern from environmental exposure. The FEVE layer should also not be too thick as excessive thickness detracts from the desired faux galvanized appearance and can result in surface blistering. NIP and KISS pressures set too high or too low will result in either a deficient protective coating or a glossy overlaid look that is uncharacteristic for a galvanized surface. NIP and KISS pressures set too high or too low result in appearances that are unappealing to the consumer and therefore must be carefully calibrated to achieve optimal surface finish and durability.

The primary application for coatings made with these resins has been in architectural markets, where the gloss and color retention offered by the resins are the main properties of interest. FEVE coatings also offer excellent corrosion resistance, especially in marine environments, which not only have high levels of ultraviolet radiation, but also high levels of corrosives. FEVE alternating copolymers are composed of two different molecules (fluoroethylene and vinyl ether) that are joined almost completely side-by-side. LUMIFLON® produced by AGC Chemicals Company, for example, provides excellent weatherability because the molecular bond energy of the FEVE structure is stronger than the energy radiated by ultraviolet light.

Once the FEVE coated substrate 20 exits the finish coater 196 it advances to a finish oven 200 where the substrate 20, the PVDF pattern 30 and FEVE coating 40 reach a peak metal temperature in the range of about 4800 F. The patterned substrate experiences an in- oven residence time of approximately 48 seconds which is sufficiently high to volatilize solvents from the resin of the applied FEVE coat. At the elevated peak metal temperature in the oven, the just applied FEVE coat undergoes a chemical reaction, or alternatively a curing of the finish, resulting in a visible printed pattern when dried and cooled.

Upon exiting the finish oven 200 the patterned 30 and FEVE coated 40 substrate 20 progresses toward the finish quench 204 which is comprised of several sets of spray bars that shower the pattern printed and finished substrate 20 with water near ambient temperature to quickly lower the temperature of the substrate and applied coating to near ambient temperature. Once the PVDF and FEVE coated substrate 20 exits the finish quench 204 it is coiled on a coil car 208 thereby completing a pass through the coating line.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings. Moreover, the order of the components detailed in the system may be modified without limiting the scope of the disclosure.

I claim:

1. A method of flexographically applying a faux galvanization coating to the surface of a coiled steel sheet, the method comprising:

advancing a leading edge of a coiled metal substrate into the feed end of a flexographic coil coating line;

advancing the metal substrate through at least one cleaning section within the coating line;

advancing the metal substrate through a pretreatment station;

advancing the metal substrate through a pretreatment oven within the coating line which raises the temperature of the substrate to approximately 300° F.;

advancing the metal substrate into a flexographic roller with a flexographic roll pattern;

applying with the flexographic roller a spangle pattern of polyvinylidene fluoride (PVDF) atop the metal substrate with the flexographic roller;

advancing the metal coil substrate with the spangle pattern into an oven;

heating the metal coil substrate and applied PVDF pattern to a peak metal temperature in the range of about 455° F. to 475° F. and maintaining a residence time in the range of about 40 to 60 seconds;

advancing the metal coil substrate with the applied PVDF pattern to a quench station to cool the metal coil substrate;

advancing the quenched metal coil substrate with the applied PVDF pattern to a flexographic roller for application of a fluoroethylene vinyl ether (FEVE) semi-transparent coating;

flexographically applying the FEVE semi-transparent coating to the substrate over the PVDF pattern;

advancing the metal coil substrate with the PVDF pattern and FEVE coating into an oven to achieve a substrate peak metal temperature in the range of about 470° F. to 490° F. to volatilize solvents from the applied FEVE coating;

advancing the heated metal substrate with the PVDF pattern and FEVE coating to a quench station; and returning the coated metal substrate to a coiled configuration at the end of the flexographic coil coating line.

2. The method of claim 1, wherein the spangle pattern has the appearance of a sponge dipped application of the coating to the substrate.

3. The method of claim 1, wherein the viscosity of the PVDF coating is set to 22-23 seconds using a #4 Zahn cup at 80° F.

4. The method of claim 1, wherein the thickness of the PVDF pattern is in the range of about 0.20 to 0.30 mils.

5. The method of claim 1, wherein the thickness of the FEVE coating is in the range of about 0.50 to 0.60 mils.

6. The method of claim 1, wherein the viscosity of the FEVE coating at 80° F. is set to 21 seconds measured with a #4Zahn cup.

7. The method of claim 1, wherein the at least one cleaning section is four cleaning sections.

* * * * *